United States Patent [19]

McCusker

[11] 4,273,543

[45] Jun. 16, 1981

[54] EMERGENCY MARINE PROPULSION USING EXISTING PROPELLER SHAFT

[75] Inventor: James D. McCusker, Bergenfield, N.J.

[73] Assignee: Engine Technology, Inc., Rahway, N.J.

[21] Appl. No.: 80,184

[22] Filed: Oct. 1, 1979

[51] Int. Cl.[3] ..... B63H 23/10

[52] U.S. Cl. ..... 440/4; 440/5

[58] Field of Search ..... 115/34 R, 34 A, 35, 115/72, 37, 18 A; 74/606 R; 64/3; 244/55, 58; 440/4, 5, 49, 75

[56] References Cited

U.S. PATENT DOCUMENTS

| | | | |
|---|---|---|---|
| 1,181,988 | 5/1916 | Breitung | 115/900 |
| 3,170,434 | 2/1965 | Ewing | 115/34 R |
| 3,709,186 | 1/1973 | Gotmalm | 115/34 A |

FOREIGN PATENT DOCUMENTS

| | | | |
|---|---|---|---|
| 469164 | 3/1926 | Fed. Rep. of Germany | 244/58 |

*Primary Examiner*—Trygve M. Blix

*Assistant Examiner*—Jesus D. Sotelo

*Attorney, Agent, or Firm*—Ralph R. Roberts

[57] ABSTRACT

The present invention pertains to an emergency propulsion system for both motor powered and sailing vessels which have a single propeller shaft. This emergency system may be used with inboard engines or with a sailing vessel that has a small engine used for moving said vessel and/or docking. While and when under way engine failure may be experienced. Such failure is usually very inconvenient to the user of the boat. Many times such failure can and does become a serious matter. The present hydraulic propulsion system of this invention is intended to provide a "get home" drive for trawlers or sailing vessels using a single engine. A small diesel engine that is used to provide electrical generation is also selectively employed to turn a hydrostatic pump and then through a fluid connected means drives a hydrostatic motor which drives a V-belt to the propeller shaft. The hydrostatic pump is operatively driven by the diesel engine but the motor is operatively connected to the propeller shaft only after the disabled main engine is disconnected from the propeller shaft.

10 Claims, 3 Drawing Figures

EMERGENCY MARINE PROPULSION USING EXISTING PROPELLER SHAFT

BACKGROUND OF THE INVENTION

1. Field of the Invention

With reference to the classification of art as established in and by the U.S. Patent Office, the present invention is believed to be found in the General Class entitled, "Marine Propulsion" (Class 115) and the Subclass entitled, "Screw Propeller-Hydraulic propulsion system" (Subclass 34A).

2. Description of the Prior Art

The use of engines and propellers for moving trawlers and sailing vessels is well known. The lack of emergency service has been a problem. It is desirable to have emergency motive means to be used as a "get home" drive. Usually, and in as far as known by the applicant, conventional "get home" auxilliary units include a small engine (usually electric) and a coupling means to "hook up" with the regular propeller shaft. Often the cost of this auxilliary equipment employing the secondary engine is more costly than is desired and hence single engine vessels of fifty feet and less often do without this auxilliary emergency equipment.

In the present invention an economical diesel engine which nominally operates a generator is also connected to a hydrostatic pump. This hydrostatic pump selectively feeds a supply of pressurized hydraulic fluid to a hydrostatic motor which is disposed at a remote distance from the generator and by means of a selectively connected V-belt drive turns a propeller shaft. The usual diesel engine provides for five, seven and one-half and ten kilowatt generator operation. Nominally the hydrostatic motor is ten to twenty horsepower with a shaft output of eight to sixteen horsepower.

SUMMARY OF THE INVENTION

This invention may be summarized, at least in part, with reference to its objects. It is an object of this invention to provide, and it does provide, an electric marine generator that nominally is driven by a diesel motor with a constant speed governor. This diesel engine, in addition to driving the generator, also drives a hydrostatic pump which is supplied by a desired hydraulic fluid from a hydraulic reservoir and filter to and through a flexible conductor. This hydraulic fluid drives the hydrostatic motor whose output is connected by means of V-belts to the propeller shaft of the marine vessel.

In essence this invention provides for a diesel engine and operatively connected generator which conventionally provides from five to ten kilowatts of 115-230 volt, three wire, single phase, sixty cycle electrical current. When it is desired or necessary to employ emergency measures for propulsion, a hydrostatic pump's output is then fed to a hydrostatic motor. This engine operates the hydrostatic pump at a relatively constant speed and this pressurized fluid is fed through flexible conductors to a hydrostatic motor. A variable displacement control is employed to shift hydrostatic motor output from forward to reverse to the hydrostatic pump. The hydrostatic motor is actuated to drive the propeller shaft only after the main engine is disconnected. The propeller shaft is then driven by means of a V-belt from the hydrostatic motor which is separately mounted, preferably on a quick release adjustable base. A clutch device may be employed to connect the output of the hydrostatic motor to drive a V-belt sheave which in turn drives the V-belt sheave on the propeller shaft.

This auxiliary propulsion is operated only when the main engine is disconnected and is inoperable. Preferably the hydrostatic motor is on a pivot and the V-belts are slipped from the hydrostatic motor sheave so there is no possibility of the hydrostatic motor operating as a pump to feed hydraulic fluid back to the hydrostatic pump. This prevents the diesel engine from overspeeding or causing a heating of the hydraulic fluid.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen a specific embodiment of an emergency "get home" propulsion system as adopted for use with propeller shafts and showing a preferred means for connecting the hydrostatic pump and motor. This specific embodiment has been chosen for the purposes of illustration and description as shown in the accompanying drawing wherein:

BRIEF DESCRIPTION OF THE DRAWING

In the following description and in the claims various details are identified by specific means for convenience. These names are intended to be generic in their application. Corresponding reference characters refer to like members throughout the three figures of the drawing.

Figure 1:
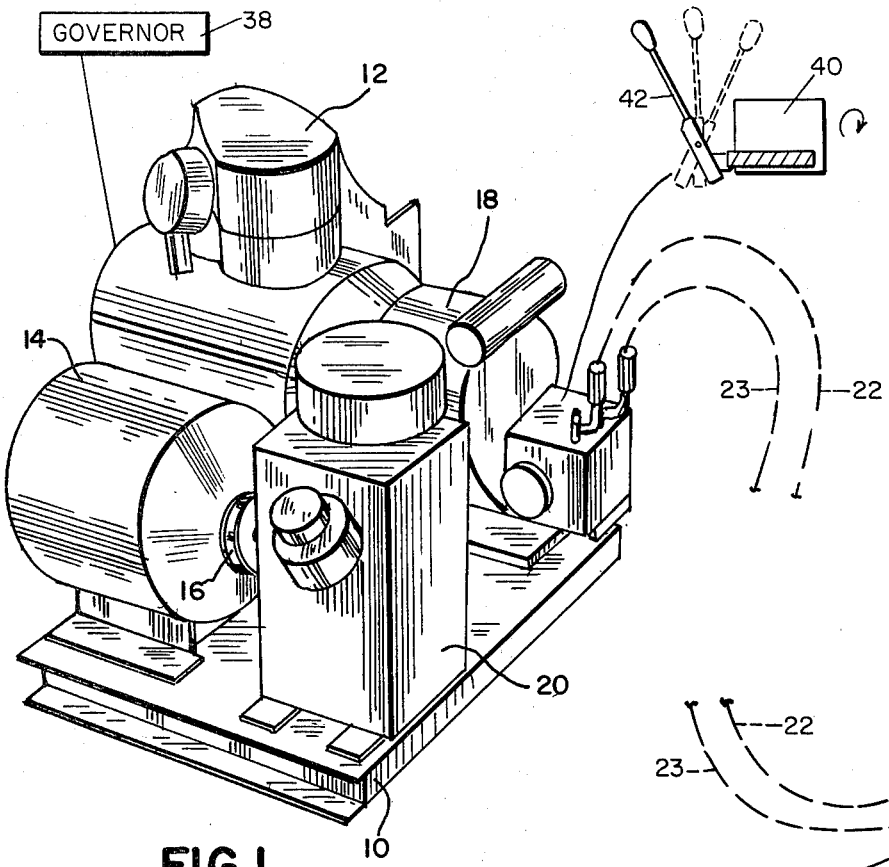
FIG. 1 represents an isometric view, partly schematic and diagrammatic, and showing a diesel engine and generator mounted on a base and connected to a hydrostatic pump, reservoir and filter.

The drawing accompanying, and forming part of, this specification disclose details of construction for the purpose of explanation but structural details may be modified without departure from the concept and principles of the invention and the invention may be incorporated in other structural forms than shown.

DETAILED DESCRIPTION OF THE PROPULSION

Figure 2:
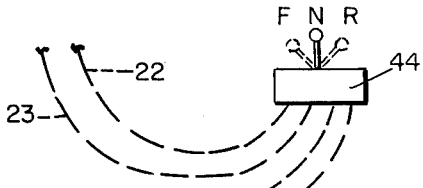
FIG. 2 represents an isometric view, partly diagrammatic, and showing in particular a remotely positioned hydrostatic motor which is removably mounted on a base with a V-belt driver sheave and a V-belt driven sheave on the main engine propeller shaft, the main engine shown in phantom outline and the propeller shaft shown in solid outline.
Figure 2:
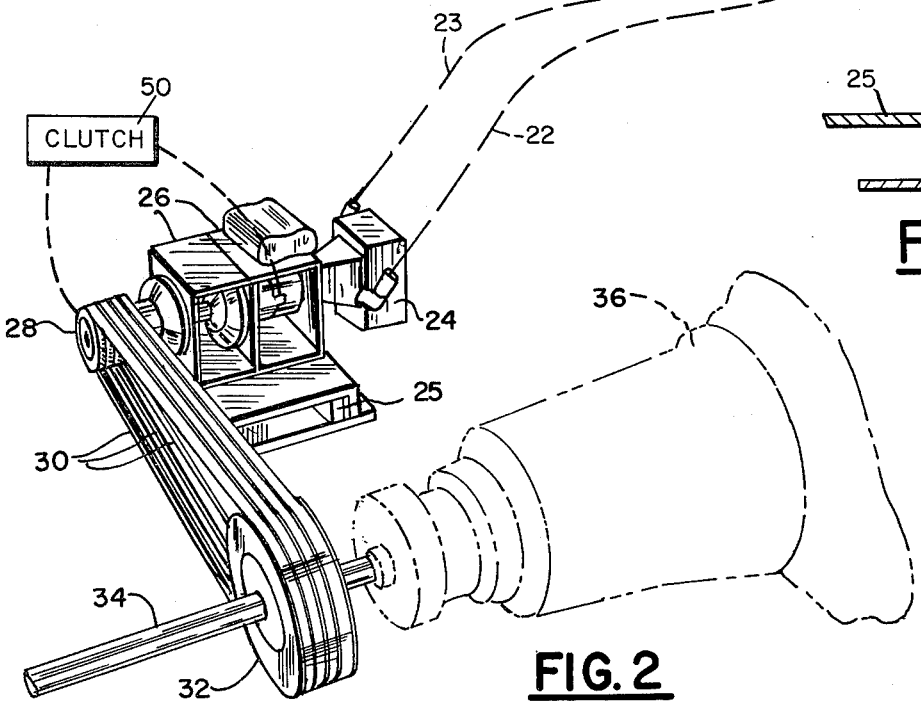

Apparatus of FIGS. 1 and 2

In FIG. 1 there is shown mounted on a base 10 a diesel engine 12 of conventional construction and use. This diesel engine 12 drives generator 14 by means of a V-belt drive 16. Also driven by said diesel engine is a hydrostatic pump 18. A hydraulic reservoir and filter is shown as a conventional unit 20. Flexible hydraulic hoses 22 and 23 lead to and from a hydrostatic motor 24. A base 25 provides a pivot support. Said motor, with conventional coupling support, is mounted in torque tubes 26, more fully described in conjunction with Allowed U.S. patent application Ser. No. 797,361, filed May 16, 1977. The Final Fee has been paid but as of now no patent number is available. The output of this hydrostatic motor 24 turns a driver sheave 28 which moves V-belts 30. These V-belts 30 in turn rotate a driven sheave 32 on the propeller shaft 34 which is selectively coupled to and driven by the main engine 36.

Use and Operation

Figure 3:
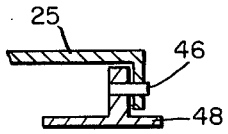
FIG. 3 represents a fragmentary sectional view showing a pivot support for the base on which the hydraulic motor is mounted.

In operation and use it is anticipated that the diesel engine 12 is connected to and drives a generator 14 producing 115–230 volts, single phase, 60 cycle electrical output. This diesel engine 12 is also connected to the hydrostatic pump 18 and turns this hydrostatic pump and generator at a constant speed as regulated by a constant speed governor 38 which is conventionally an automatic or manual control. Said governor operates with a plus or minus of two percent to a preset speed. In normal operation the hydrostatic pump is put into neutral and produces no flow generation output. The hydrostatic pump usually provided is a variable displacement pump (Sundstrand Corp., Ames, Iowa) which has a swash plate 40. This swash plate is moved by a connected lever 42 to produce the desired direction and amount of fluid flow. There are two flexible hydraulic hoses 22 and 23 leading to the hydrostatic motor 24 and this hydrostatic motor 24 receives the output from the hydrostatic pump 18. When the pump is a constant volume pump the lines 22 and 23 are fed to and from a valve 44. This motor is pivotally mounted on base 25 so that the V-belts 30 are normally not tight in the grooves in driven sheave 28 until the main engine 36 has failed. In FIG. 3 is shown a pivot support in which the base 25 is carried by pins 46 carried in support base 48. The clutch on the main engine 36 is disconnected to allow the propeller shaft 34 to be rotated. When and as the V-belts 30 are put on the sheaves 32 and 28 and the hydrostatic motor 24 is swung and locked into position on the base 25, the main engine 36 is brought to a non-driving condition. The V-belts 30 driven by the hydrostatic motor 24 are in a driving condition so that propeller shaft 34 may be rotated by the hydrostatic motor 24. The diesel engine is, of course, operating at its predetermined speed whereupon the hydrostatic pump 18 is brought into effective drive condition causing the hydrostatic motor 24 to rotate in its desired direction and speed while still driving the generator. This hydrostatic motor 24 rotates the propeller shaft 34 and moves the vessel forward or back as desired. When it is desired to reverse the rotation of the propeller the hydrostatic pump 18 is reversed so that the hydrostatic motor 24 similarly moves the V-belts, the sheaves, and the propeller in the reverse direction.

The hydrostatic pump, motor and flow control utilizes off-the-shelf, commercially available components. The selection of the drive will depend upon cost, convenience and the design of the vessel. Instead of the pivoted base 25, the base 25 may be moved by a threaded bolt to provide the desired loosening of the V-belt drive. In certain circumstances it may not be desirable to provide a disconnect of the V-belt drive whereat declutching of the hydrostatic motor 24 is necessary. Electro clutch 50 may be provided in pulley 28 or may replace the coupling seen in the torque tube housing 26. This clutch is a matter of selection when desired by the customer.

This apparatus provides a practical, rugged "get home" drive for single engine vessels. The simple arrangement for placing the V-belt drive into driving operation takes only a few seconds and is so designed as to prevent any accidental engagement from taking place. Full power from the diesel engine is used to drive the hydrostatic pump and fluid connected hydrostatic motor. An all-electric drive often employed produces only fifty percent efficiency whereas the hydrostatic drive above shown and described is eighty percent efficient. Said all-electric drives often produce high voltage electricity in the vessel bilge whereas there is none produced in the present invention.

The present invention can be continuously operated with safety and the pump control enables the propeller to be rotated from full ahead to full reverse. The operator of the vessel is able to exactly match the propeller load. The power station, the hydrostatic motor and the V-belt drive is readily serviced or replaced.

Terms such as "left", "right", "up", "down", "bottom", "top", "front", "back", "in", "out" and the like are applicable to the embodiment shown and described in conjunction with the drawing. These terms are merely for the purposes of description and do not necessarily apply to the position in which the hydrostatic propulsion system may be constructed or used.

While a particular embodiment of the emergency propulsion means has been shown and described it is to be understood the invention is not limited thereto since modifications may be made within the scope of the accompanying claims and protection is sought to the broadest extent the prior art allows.

What is claimed is:

1. An emergency marine propulsion means for vessels having a single propeller shaft normally driven by a main engine, said propulsion means including:

(a) an electrical generator adapted to generate electrical current of a given voltage and amperage when rotated at a selected speed to deliver this current for use on said vessel;

(b) a diesel engine adapted to drive said electrical generator by and through a connected means;

(c) means for maintaining a relatively constant regulated and desired speed of the diesel engine and generator;

(d) means for driving a connected hydrostatic pump by the diesel engine;

(e) a hydraulic reservoir and filter adapted to feed filtered hydraulic fluid from the reservoir to the driven hydrostatic pump;

(f) a hydrostatic motor adapted for rotative motion in either direction by delivered pressurized hydraulic fluid from the driven hydrostatic pump;

(g) a pair of hydraulic conductors adapted to carry pressurized hydraulic fluid from the hydrostatic motor to the hydrostatic pump and a return flow from the hydrostatic motor to the hydrostatic pump;

(h) means for regulating the amount and direction of flow from the hydrostatic pump to the hydrostatic motor to rotate said motor in the desired direction and at a selected speed;

(i) a flexible drive adapted to connect the output of the hydrostatic motor to drive means provided on said single propeller shaft, and (j) means for disengaging the flexible drive from the hydrostatic motor to said propeller shaft when and while the main engine is operatively connected to the propeller shaft.

2. An emergency marine propulsion means as in claim 1 in which the means for maintaining the constant speed in and by the diesel engine is a governor adapted to maintain the determined speed within two percent.

3. An emergency marine propulsion means as in claim 1 in which the generated electrical output is single phase, sixty cycle voltage at approximately five to ten thousand watts.

4. An emergency marine propulsion means as in claim 1 in which the output and direction of the hydrostatic flow from the pump is controlled by a variable displacement pump and the hydrostatic motor is of the fixed displacement type.

5. An emergency marine propulsion means as in claim 1 in which the generator, diesel motor, hydrostatic pump, reservoir and filter are mounted to a base for ready installation and removal as a unit.

6. An emergency marine propulsion means as in claim 1 in which the pair of hydraulic conductors are flexible hydraulic hoses.

7. An emergency marine propulsion means as in claim 1 in which the hydrostatic motor is mounted on a base with a pivot support so that said motor can be selectively connected to a flexible drive from the hydrostatic motor to the propeller shaft.

8. An emergency marine propulsion means as in claim 7 in which the hydrostatic motor and its output shaft are carried by a torque tube of open construction.

9. An emergency marine propulsion means as in claim 1 in which the flexible drive is a V-belt drive including a V-belt sheave on the output shaft of the hydrostatic motor and a matching V-belt sheave on the propeller shaft with suitable V-belts therebetween.

10. An emergency marine propulsion means as in claim 1 in which the output from the hydrostatic motor includes a disconnect clutch that is operatively disconnected when and while the main engine produces power output.

* * * * *